US010214948B2

(12) United States Patent
Richmond

(10) Patent No.: US 10,214,948 B2
(45) Date of Patent: Feb. 26, 2019

(54) DOOR BARRICADE

(71) Applicant: Campus Safety Products, LLC, Raleigh, NC (US)

(72) Inventor: Matthew Todd Richmond, Dumphries, VA (US)

(73) Assignee: Campus Safety Products, LLC, Raleigh, NC (US)

( * ) Notice: Subject to any disclaimer, the term of this patent is extended or adjusted under 35 U.S.C. 154(b) by 0 days.

(21) Appl. No.: 15/005,509

(22) Filed: Jan. 25, 2016

(65) Prior Publication Data

US 2017/0211301 A1 Jul. 27, 2017

(51) Int. Cl.

| | |
|---|---|
| ***E05C 1/04*** | (2006.01) |
| ***E05C 5/00*** | (2006.01) |
| ***E05B 63/18*** | (2006.01) |
| ***E05C 17/00*** | (2006.01) |
| ***E05C 17/12*** | (2006.01) |

(Continued)

(52) U.S. Cl.

CPC ..... *E05C 19/003* (2013.01); *E05B 63/18* (2013.01); *E05C 1/04* (2013.01); *E05C 5/00* (2013.01); *E05C 17/00* (2013.01); *E05C 17/12* (2013.01); *E05C 17/16* (2013.01); *E05C 17/44* (2013.01); *E05C 17/46* (2013.01); *E05C 17/50* (2013.01); *E05C 19/002* (2013.01); *E05C 19/004* (2013.01); *E05C 19/18* (2013.01); *E05C 19/184* (2013.01); *Y10T 292/0891* (2015.04); *Y10T 292/37* (2015.04); *Y10T 292/65* (2015.04); *Y10T 292/67* (2015.04); *Y10T 292/71* (2015.04); *Y10T 292/73* (2015.04)

(58) Field of Classification Search

CPC ..... E05C 19/003; E05C 5/00; E05C 17/06; E05C 17/12; E05C 17/16; E05C 19/004; E05C 19/002; E05C 19/18; E05C 19/184; E05C 17/00; E05C 17/44; E05C 17/48; E05C 17/50; E05C 17/46; E05C 17/443; Y10T 292/65; Y10T 292/67; Y10T 292/083; Y10T 292/37; Y10T 292/71; Y10T 292/73

USPC .... 292/67, 28, 289, 342, 343, DIG. 15, 338, 292/339

See application file for complete search history.

(56) References Cited

U.S. PATENT DOCUMENTS 365,038 A 6/1887 Axdees
712,270 A * 10/1902 Dilthey et al. ..... E05B 17/0025 292/153

(Continued)

FOREIGN PATENT DOCUMENTS

CA 1379674 C 1/1991
CA 1302786 C 6/1992

(Continued)

OTHER PUBLICATIONS

Door Jammer./ Portable Door Security Device, Amazon.com, http://www.amazon.com/Door-Jammer-Portable-Security-Device/sim/B00BZB97AM/2, Apr. 26, 2015.

(Continued)

*Primary Examiner* — Kristina R Fulton
*Assistant Examiner* — Faria F Ahmad
(74) *Attorney, Agent, or Firm* — James G. Passé; Passé Intellectual Property, LLC

(57) ABSTRACT

The present invention is a door barricade having a pivoting locking arm which drops into a floor hole to lock a barricade in place.

15 Claims, 3 Drawing Sheets

(51) Int. Cl.

| | |
|---|---|
| ***E05C 17/16*** | (2006.01) |
| ***E05C 17/44*** | (2006.01) |
| ***E05C 17/46*** | (2006.01) |
| ***E05C 17/50*** | (2006.01) |
| ***E05C 19/00*** | (2006.01) |
| ***E05C 19/18*** | (2006.01) |

(56) References Cited

U.S. PATENT DOCUMENTS 1,448,298 A * 3/1923 Hight ..... E05C 1/14 16/83
1,505,184 A * 8/1924 Zukor ..... E05C 19/004 292/338
1,589,149 A * 6/1926 Hanle ..... E05B 65/48 292/210
1,605,208 A * 11/1926 Blakely ..... E05C 17/443 292/238
1,721,257 A * 7/1929 Myers ..... E05C 17/443 292/238
1,723,007 A * 8/1929 Bittorf ..... E05B 17/2076 292/57
2,153,232 A * 4/1939 Beck ..... E05C 17/50 16/86 R
2,396,982 A * 3/1946 Bousquet ..... E05C 19/182 16/380
2,403,065 A * 7/1946 Engert ..... E05C 1/04 292/340
2,764,442 A * 9/1956 Weaver ..... E05B 65/0835 292/194
3,024,056 A * 3/1962 Cook ..... E05C 17/446 292/177
3,336,075 A * 8/1967 Wilson ..... E05D 11/1007 16/323
3,351,122 A 11/1967 Murphy
3,399,918 A * 9/1968 Nagy ..... E05C 17/50 16/86 A
3,791,687 A * 2/1974 Schroeder ..... E05C 17/56 292/251.5
3,861,726 A * 1/1975 McLennan ..... E05C 3/048 292/205
4,050,723 A * 9/1977 Papadatos ..... E05C 17/446 292/164
D255,212 S 6/1980 Weigand et al.
4,322,100 A * 3/1982 McLennan ..... E05C 3/048 292/67
4,666,195 A * 5/1987 Thomas, III ..... E05C 17/443 292/336.3
4,671,014 A 6/1987 Lack
4,759,577 A * 7/1988 Thomas, III ..... E05C 17/443 292/338
4,854,791 A 8/1989 Brown
5,040,835 A 8/1991 Barker
5,114,193 A * 5/1992 Nass ..... E05C 3/047 292/67
5,253,905 A 10/1993 Hutson
5,395,143 A * 3/1995 Chesterton ..... E05C 17/48 292/57
5,398,982 A * 3/1995 Watson, Jr. ..... E05C 3/048 292/259 R
5,407,240 A * 4/1995 Andre ..... E05B 65/08 292/189
5,454,610 A 10/1995 Taylor et al.
5,473,841 A 12/1995 Grillo
5,489,129 A * 2/1996 Shepherd ..... E05B 17/208 292/63
5,490,304 A * 2/1996 Winner, Jr. ..... E05F 5/06 16/82
5,531,490 A * 7/1996 Parker ..... E05C 17/04 16/82
5,539,954 A * 7/1996 Ambar ..... E05B 65/0071 16/82
5,590,918 A * 1/1997 Kambalov ..... E05C 17/00 16/82
5,618,072 A * 4/1997 Pitchford ..... E05C 19/004 292/339
5,692,787 A * 12/1997 Young ..... E05C 19/004 292/338
5,711,555 A * 1/1998 Leedy ..... E05C 19/184 292/202
5,836,049 A * 11/1998 Chiang ..... E05C 17/50 16/82
5,934,116 A * 8/1999 Moore ..... E05B 67/383 292/218
5,983,680 A * 11/1999 Del Nin ..... E05C 17/38 16/82
5,992,909 A 11/1999 Vindum
6,032,329 A 3/2000 Casalie
6,149,209 A * 11/2000 Barton ..... E05C 5/00 292/189
6,161,252 A * 12/2000 Rodriguez ..... E05C 17/52 16/82
6,308,996 B1 10/2001 Ganimian
6,321,411 B1 * 11/2001 Lkejiri ..... E05C 17/56 16/82
6,340,185 B1 * 1/2002 Truong ..... E05C 17/50 16/82
D453,470 S 2/2002 Prasad
6,471,264 B1 * 10/2002 Ryan ..... E05C 1/04 292/251.5
6,557,912 B1 * 5/2003 Truong ..... E05C 17/50 292/338
6,782,724 B2 * 8/2004 Kelly ..... E05B 83/02 292/DIG. 15
7,014,229 B1 * 3/2006 Stelmach ..... E05C 17/44 292/342
7,216,902 B2 * 5/2007 Marra ..... E05C 19/182 292/251.5
7,513,542 B2 * 4/2009 Schumm ..... E05C 17/446 292/163
8,210,504 B1 * 7/2012 Skornickel ..... E04H 17/1421 256/65.01
8,250,811 B2 * 8/2012 Zijlstra ..... E05C 1/10 292/57
8,382,169 B2 * 2/2013 Bosshard ..... E05C 17/56 292/251.5
8,403,382 B2 * 3/2013 Della-Santa ..... E05C 17/02 16/82
8,414,040 B1 * 4/2013 Rhodes ..... E05B 53/003 292/288
8,794,681 B2 * 8/2014 Crosse ..... E05C 1/04 292/189
8,894,110 B2 * 11/2014 Taylor ..... E05C 19/184 292/338
9,238,926 B2 * 1/2016 Guerrero ..... E05B 17/2076
9,470,032 B2 * 10/2016 Swanberg ..... E05F 5/06
2004/0070217 A1 * 4/2004 Demlow ..... E05C 17/443 292/339
2004/0181902 A1 * 9/2004 Pierce ..... E05C 17/443 16/49
2006/0043739 A1 * 3/2006 Gogel ..... E05B 17/2023 292/148
2007/0000293 A1 1/2007 Daniels et al.
2008/0127457 A1 * 6/2008 Deng ..... E05C 17/443 16/402
2009/0322473 A1 12/2009 Aliferis et al.
2011/0291426 A1 * 12/2011 Gibson ..... E05C 19/003 292/137
2011/0304164 A1 12/2011 Salo et al.
2012/0056438 A1 * 3/2012 Enderle ..... E05C 17/50 292/194
2014/0217754 A1 * 8/2014 Taylor ..... E05C 19/184 292/288
2014/0312634 A1 10/2014 Cushwa et al.
2015/0211269 A1 * 7/2015 Gehrke ..... E05C 17/48 292/338
2016/0186470 A1 6/2016 Finley et al.

(56) References Cited

U.S. PATENT DOCUMENTS

| | | | | |
|---|---|---|---|---|
| 2016/0215538 | A1* | 7/2016 | Pistone | E05C 17/443 |
| 2018/0148960 | A1 | 5/2018 | Finley | |
| 2018/0158268 | A1 | 6/2018 | Comerford et al. | |

FOREIGN PATENT DOCUMENTS

| | | | |
|---|---|---|---|
| WO | 1988003216 | A1 | 5/1988 |
| WO | 2014121154 | A1 | 8/2014 |

OTHER PUBLICATIONS

Nightlock, https://www.youtube.com/watch?v=YBIQP6uFp-I, http://nightlock.com/ , Apr. 26, 2015.

* cited by examiner

DOOR BARRICADE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a door safety barricade. In particular, the present invention relates to a device for barricading a door from the inside during an emergency situation.

Description of Related Art

The more frequent occurrence of intruders in schools, businesses and government facilities has highlighted safety needs for people working at or using such facilities, such as students in a school. Schools and other facilities are constantly attempting to prevent an intruder from entering classrooms, offices, and the like. In an intruder situation, many places go into a lockdown situation where people remain in place. The responders can take an average of 18 minutes before they can reach the situation if no security is readily present and, as such, keeping the occupants of a room safe from entry by an intruder is the critical effort while waiting for responders. An effective door barricade is needed to allow time for the responders to arrive and protect the room occupants.

In schools, and most buildings, there are many kinds of doors. Some swing outward, while others swing inwards. In addition, some doors are double doors that open in the middle of the two doors, either in or out. In addition, many schools and the like do not allow door locks on the interior. Where there are door locks, they require going outside the classroom in the hallway into the line of danger in order to utilize the door lock.

Many rooms in these situations have a window in the door, or next to the door, making it relatively easy to break the window and reach in to the door knob and unlock and open the door.

The devices attempting to deal with the situation have used various approaches. There are devices that attach to the door jamb, but the door can still easily be kicked in and break the door jamb. There are a number of devices that attach between the inside face of the door and the floor, but they all have a removable pin, key or the like, which can be lost or stolen, rendering the device useless in an emergency.

BRIEF SUMMARY OF THE INVENTION

The present invention relates to a door barricade mounting between the interior face of the door and the adjacent floor that succeeds in overcoming the problems of the previous attempts at barricading the door. It allows for an individual to instantly barricade the door and barricade it in such a way that no parts can be lost and that it is difficult or impossible to tamper with from the outside without a specialized tool in the hands of responders. The door barricade can be engaged on doors without door handles and without having to open the door first.

Accordingly, the present invention relates to a door barricade for a door designed for mounted between an interior face of the door and an adjacent floor comprising:

a) a door interior face mounting plate;
b) a vertical bolt capable of rotating circumferentially and moving up and down;
c) a front plate for mounting the vertical bolt such that the front plate can hold the vertical bolt in an up position and a down position;
d) a floor plate with a receiver hole;
e) a locking arm attached to the vertical bolt, having a locking foot which fits into the floor receiver hole when the bolt is in the down position;
f) at least one each of a left and right restrictor plate which prevents the vertical bolt from rotating circumferentially clockwise or counterclockwise when the locking arm is in the down position: and
g) a rest plate for holding the locking arm in the up position.

DETAILED DESCRIPTION OF THE INVENTION

Figure 1:
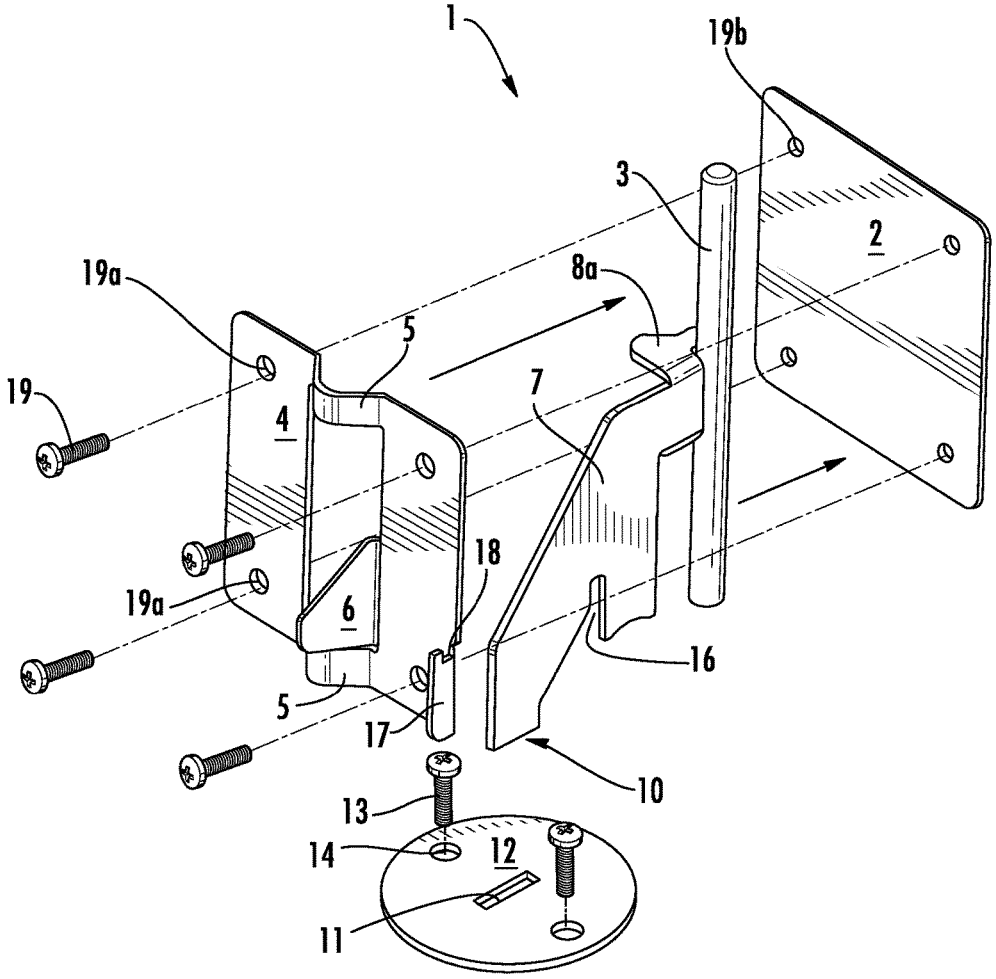
FIG. 1 is an exploded perspective view of the door barricade.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the phrase "door barricade" refers to a mechanism which can secure and fortify an entryway door to withstand an attempt to gain entry by force. In the case of the present invention, it is easily engaged and works regardless of other conventional locking mechanisms. The present invention door barricade is a device that mounts both on the interior face of a room door (such as a classroom) and on the adjacent floor to the interior face of the door, preventing opening of the door by the connection of the door to the floor.

As used herein, the phrase "interior face of the door" refers to the side of a room door, such as a classroom, which faces the interior of the room. The exterior face is the opposite side of the door where a person would approach to gain entry such as from the outside or a hallway into a classroom.

As used herein, the phrase "adjacent floor" refers to the floor in the room closest to the interior face of the door. This can be clearly seen in the drawings and is clear from the description herein.

As used herein, the phrase "door interior face mounting plate" refers to a plate mounted against the interior face of the door to be barricaded. It acts to help attach the front plate to the door, and acts to prevent access to the device from the outside by going through the door. The mounting plate can be made from any sufficiently strong metal, or reinforced other material, to resist damage or breaking. It therefore can be steel (e.g. rolled steel), titanium, thick aluminum, or the like.

As used herein, the phrase "front plate" refers to a second plate which mounts onto the mounting plate and is designed in such a fashion that a vertical bolt is held between both the mounting plate and the front plate in a manner that allows the bolt to move up and down, as well as circumferentially in both directions (clockwise and counter-clockwise). It is also made of steel, thick aluminum, or other rigid sturdy metal. The bolt can be held loosely, as in the figures, by providing two or more wrap around positions that form a cylindrical opening between the two plates for operation. One could envision other means or larger, smaller, or more such bands to hold the vertical bolt in view of the drawings and description herein.

As used herein, the phrase "vertical bolt" refers to a metal pin or bar that is positioned vertically in-between the front and mounting plates. The bolt is held between the two plates such that it can move up and down between a down position and an up position and is therefore long enough to accomplish that feat. As shown in the figures, the vertical bolt is longer than the two plates, but the plates could be longer and thus the bolt could be of similar height as the plates. Again, the bolt can be steel, aluminum or other rigid material or metal.

As used herein, the phrase "floor plate with a receiver hole" refers to a metal plate mounted into the adjacent floor by screwing, bolting, or the like, so that it is fixed in position. It has a hole in it, such as a round, rectangular or slot-like hole, as a receiving hole to receive the foot of the locking arm holding it in place on the floor.

As used herein, the phrase "locking arm" refers to an arm that is attached, such as by welding, to the vertical bolt, such that it travels up and down as the bolt travels from its up position to a down position. There is a locking foot at the bottom of the locking arm, such that when the bolt is in the lower position, the foot extends about to the floor. It is designed of a shape to fit into the hole in a receiver plate in the floor, and thus creates a locked position to barricade the door. In the down and locked position the vertical bolt is kept from moving circumferentially. In one embodiment, the foot is of a shape that will fit into a slot (as shown in the Figures). Because there is the plates (and the door) behind the bolt, the locking arm and the bolt can only rotate 180 degrees, from against the plates on one side to the other, as can be seen in the figures. In general, the down position will have the locking arm essentially perpendicular to the plates and the interior door face, since this is the strongest position for resisting force from the exterior face of the door.

As used herein, the phrase "restrictor plate" refers to processes, ridges, tabs or the like that keep the arm from rotating circumferentially when it is in the down position. They can be on the locking arm, or on the front plate, or as desired. The restrictor plates are positioned as well to allow rotation circumferentially when in the up position, and to allow the locking arm to rotate against the mounting plate and keep it folded out of the way when not in use. In one embodiment, shown in the Figures, the locking arm only rotates against the right side and not the left side but other versions are clearly possible in view of these drawings.

As used herein, the phrase "rest plate" refers to a tab or the like to assist or rest the locking arm in the up position. In one embodiment shown in the figures, there is a plate mounted on the mounting plate and a slot on the arm which are matched, allowing the arm to rest on the rest plate and hold it in position when not in use.

Other features could optionally be added to the device, including a lifting tab to aid in raising and lowering the locking arm and bolt from the upper position to the lower position, instructions for use, and signs indicating when the device is in active use. Screws with special heads which resist removal, emergency information and the like.

Now referring to the drawings, FIG. 1 is a perspective exploded view of the door barricade of the present invention. In this view, door barricade 1 comprises door face mounting plate 2 for mounting on the interior face of a door. Vertical bolt 3 is positioned between a front plate 4 and the mounting plate 2 for holding the vertical bolt vertically and allowing it to move from an up position to a down position. Holding bars 5 hold the bolt 3 from moving forward. Front plate 4 also has right restrictor plate 6 designed to keep the locking arm 7 from rotating to the right when it is in the down position. Vertical bolt 3 has locking arm 7 welded to it, so that they act as one piece. Left restrictor plate **8*a* keeps the bolt 3** from rotating left in the down position, and also acts as a tab to grab and assist raising and lowering the bolt from the upper to the lower position.

Locking arm 7 has foot 10, which has a rectangular shape for fitting into slot type hole 11 in floor plate 12, which is screwed by screws 13 by holes 14 into a floor adjacent to the interior face of a door. When raised into an upper position slot 16 on arm 7 fits on the slot 18 on rest plate 17. Front plate 4 is attached to mounting plate 2 and a door (see other figures) via screws 19 in holes 19*a* and 19*b*.

Figure 2:
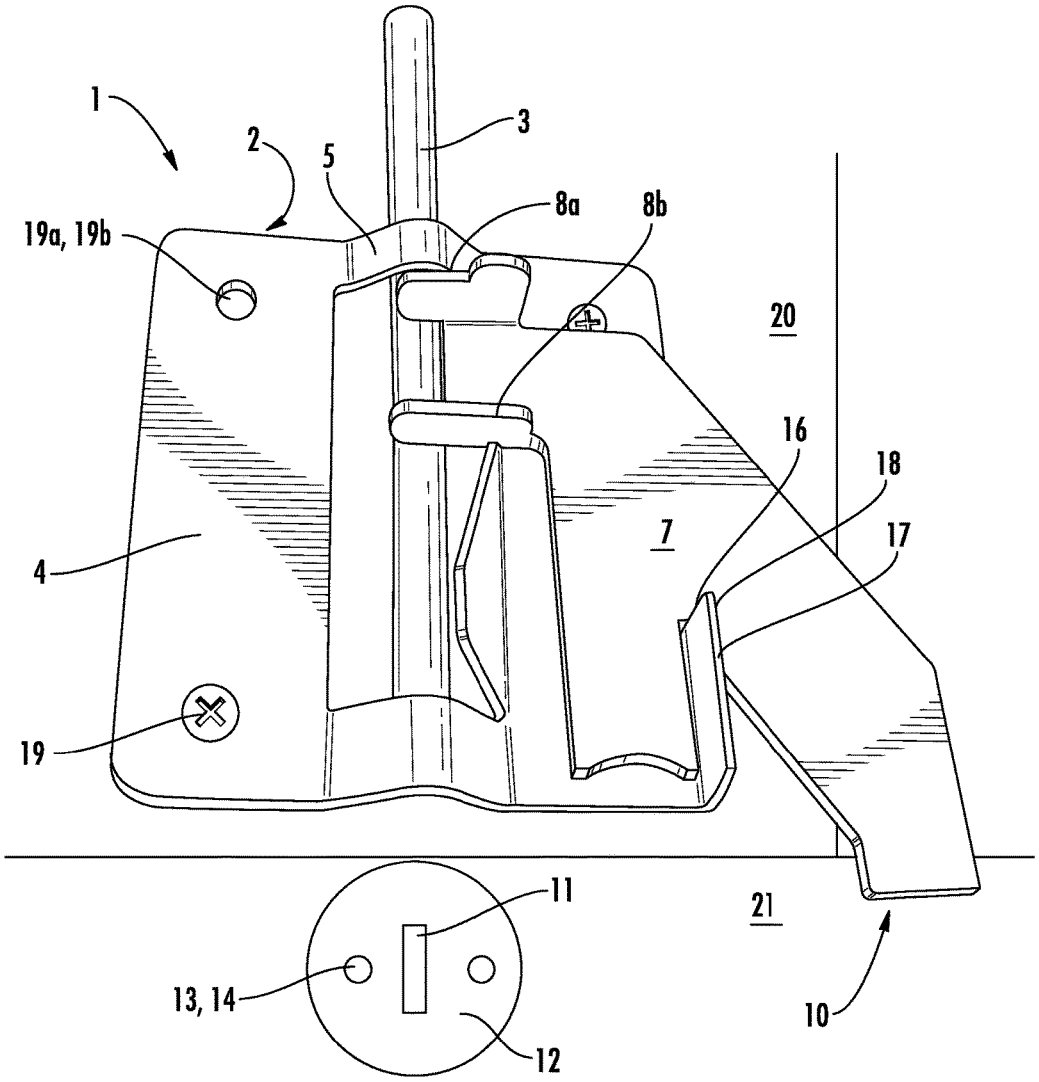
FIG. 2 is a frontal view of the device mounted between a door and floor in the open and up position.

FIG. 2 is a frontal view of device 1 mounted on door 20 and adjacent floor 21 in an open position, with the slot 16 of arm 7 resting on slot 18 of rest plate 17. A second left restrictor plate 8*b* is also shown in this view.

Figure 3:
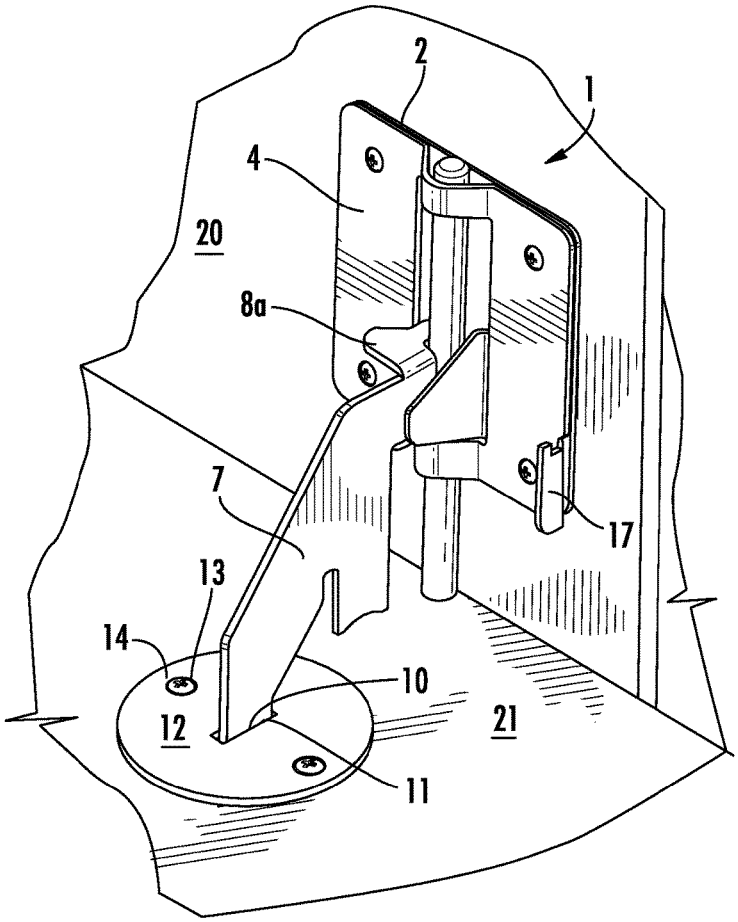
FIG. 3 is a perspective view of the device mounted between door and floor in the locked and down position.

FIG. 3 shows a perspective view of device 1 in the down locked position, wherein foot 10 is inserted in slot 11 and the bolt is kept from moving circumferentially by the restrictor plates.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A door barricade for a door having an interior face and an exterior face, the door barricade designed for use on the interior face and locking in an adjacent floor comprising:

a) a door interior face flat mounting plate, the mounting plate consisting of an exterior face and an interior face designed for vertically mounting the interior face of the mounting plate against the interior face of the door of a material designed to help prevent access to the barricade from the exterior face of the door and designed such that the flat mounting plate is the only part of the barricade touching the interior face of the door;

b) a straight vertical bolt capable of rotating circumferentially and moving up and down to an upper and lower position of a length that does not reach the floor when the bolt is in a down position attached to the barricade in spaced relationship to the interior face of the door;

c) at least one holding device attached to the mounting plate designed to keep the vertical bolt vertical relative to the mounting plate and allow the vertical bolt to rotate circumferentially and move in an upward and downward manner to the upper and lower position;

d) a single floor device with a receiver hole for attaching to the adjacent floor; and e) a locking arm fixedly attached to the vertical bolt having a fixedly attached locking foot at the bottom of the locking arm extending below a bottom of the straight vertical bolt, the foot in horizontal fixed spaced relationship to the vertical bolt and capable of locking only into the single adjacent floor receiver hole when the bolt is in the down position.

2. The door barricade according to claim 1 wherein the locking arm is perpendicular to the vertical bolt.

3. The door barricade according to claim 1 wherein the locking arm rotates circumferentially when moving between the up position and the down position.

4. The door barricade according to claim 1 wherein the mounting plate is removably held against the interior face of the door by a plurality of screws or bolts.

5. The door barricade according to claim 1 wherein there is at least one restrictor plate which is designed and positioned to keep the locking arm from rotating when the locking arm is in the down position.

6. The door barricade according to claim 5 wherein at least one of the at least one restrictor plates is attached to the locking arm.

7. The door barricade according to claim 1 wherein there is a tab on the locking arm positioned to aid in moving the bolt between the up position and the down position.

8. The door barricade according to claim 5 wherein there is at least one of the at least one restrictor plates on each of the holding device and locking arm.

9. The door barricade according to claim 1 wherein the holding device is a front plate.

10. The door barricade according to claim 1 which further comprises emergency information that shows or transmits information in an emergency.

11. The door barricade according to claim 1 which further comprises an arm slot which rests on a slotted arm receiving rest slot which holds the bolt in the upper position.

12. The door barricade according to claim 1 wherein the receiver hole is rectangular.

13. The barricade according to claim 1 further comprising a slotted receiving rest plate.

14. A door barricade for a door having an interior face and an exterior face designed for use on the interior face and locking in an adjacent floor comprising:

a. a straight vertical bolt capable of rotating circumferentially and moving up and down to an upper and lower position of a length that does not reach the floor when the bolt is in a down position attached to the barricade in spaced relationship to the interior face of the door;

b. a single floor device with a receiver hole for attaching to the adjacent floor; and c. a locking arm fixedly attached to the vertical bolt having a locking foot at the bottom of the locking arm extending below a bottom of the straight vertical bolt, the foot in horizontal fixed spaced relationship to the vertical bolt and locking into the adjacent floor receiver hole when the bolt is in the down position.

15. The door barricade according to claim 1 wherein the locking arm is a plate.

* * * * *